US006057521A

United States Patent [19]

Krebs et al.

[11] Patent Number: 6,057,521

[45] Date of Patent: May 2, 2000

[54] SUSPENDED CONTROL PANEL

[75] Inventors: Wolfgang Krebs, Wetter; Günter Somborn, Hagen; Klaus-Dieter Oemus, Hemer; Anton Münzebrock, Dortmund; Eckerhardt Grieb, Hagen; Uwe Lichtenvort, Essen, all of Germany

[73] Assignee: Mannesmann Aktiengesellschaft, Düsseldorf, Germany

[21] Appl. No.: 09/081,588

[22] Filed: May 19, 1998

Related U.S. Application Data

[63] Continuation-in-part of application No. 08/689,810, Aug. 14, 1996, abandoned.

[30] Foreign Application Priority Data

Aug. 16, 1995 [DE] Germany ..... 195 31 925

[51] Int. Cl.[7] ..... H01H 9/02

[52] U.S. Cl. ..... 200/298; 200/5 A; D18/7

[58] Field of Search ..... 200/298, 512, 200/5 A; 341/22; 379/368, 370, 369; 345/169; D14/115; D18/7, 11

[56] References Cited

U.S. PATENT DOCUMENTS

| | | | |
|---|---|---|---|
| Re. 32,977 | 7/1989 | Gotoh et al. | 200/5 A |
| 2,791,665 | 5/1957 | Baumbach | 200/298 |
| 3,627,930 | 12/1971 | Tolman | 379/370 |
| 4,209,681 | 6/1980 | Somborn et al. | 200/298 |
| 4,320,573 | 3/1982 | Larson | 200/5 A X |
| 4,321,441 | 3/1982 | Thornburg . | |
| 4,520,247 | 5/1985 | Pancook et al. | 200/298 |
| 4,876,415 | 10/1989 | Clancy | 200/5 A |
| 4,987,279 | 1/1991 | Hirose et al. . | |
| 5,008,496 | 4/1991 | Schmidt et al. | 361/749 |
| 5,526,232 | 6/1996 | Kolberg et al. | 361/715 |
| 5,610,602 | 3/1997 | Hargreaves | 200/5 A X |

FOREIGN PATENT DOCUMENTS

| | | |
|---|---|---|
| 2 210787 | 9/1973 | Belgium . |
| 27 56 103 | 2/1980 | Belgium . |
| 92 08 072 | 9/1992 | Belgium . |
| 0 374 962 | 3/1995 | European Pat. Off. . |
| 28 43 024 | 4/1982 | Germany . |
| 31 35 139 | 3/1983 | Germany . |

*Primary Examiner*—Renee S. Luebke
*Attorney, Agent, or Firm*—Cohen, Pontani, Lieberman & Pavane

[57] ABSTRACT

A cost-effective ergonomic shaped suspended control panel for remotely controlling machinery, such as hoists or cranes. The suspended control panel has two curved housing portions and a curved circuit card mounted in the interior of the curved housing. Keys are mounted to the front side of the circuit card and switching devices are mounted to the back side of the circuit card. An electric line, supported by a cable, is electronically connected to the circuit card, the keys and the switching devices. The control panel is easily assembled through use of plug sockets for connecting the switching devices to the circuit board. Each plug socket is mounted with spring clamps which extend through the circuit card for wiring.

13 Claims, 2 Drawing Sheets

SUSPENDED CONTROL PANEL

RELATED APPLICATIONS

This application is a Continuation-in-Part of U.S. patent application Ser. No. 08/689,810 filed Aug. 14, 1996, now abandoned which claims priority from Application No. 195 31 925.7 filed Aug. 16, 1995 in Germany. The disclosure of U.S. patent application Ser. No. 08/689,810 is incorporated herein by reference.

BACKGROUND OF THE INVENTION

1. Field of the Invention

The present invention relates to a control panel used, for example, for remotely controlling the operation of a hoist or crane.

2. Description of the Related Art

A suspended control panel is disclosed in German patent document DE-AS 27 56 103, which corresponds to U.S. Pat. No. 4,209,681. Although the panel is effective, there is a need for such a panel that is less expensive to manufacture, is easier to assemble, and has an optimal ergonomic design. In devices of this type, the external form determines the arrangement and design of the interior components. Until now, it was not possible to manufacture an ergonomic control panel with inexpensive circuitry including digital internal components. It was not considered feasible to accommodate such circuitry into switch housings which deviated from a straight-line design.

SUMMARY OF THE INVENTION

The present invention provides a suspended control panel having a curved shape of optimal ergonomic design. Despite its curved shape, the suspended control panel of the present invention can be manufactured cost-effectively, is easy to assemble and has an optimal ergonomic design.

The suspended control panel of the present invention includes a housing having two parts, a front portion and a rear portion. During operation, an operator stands facing the front portion of the housing which is curved in a vertically concave manner with respect to the operator facing the front portion. A circuit card within the housing extends essentially parallel to the curve of the front portion. The curved circuit card is mounted within the front portion of the housing. Operating elements, such as keys or buttons, and a display unit, are arranged on the front side of the card for operating switching devices arranged on the back side of the card. The curved circuit card comprises a resilient material and is flat during its manufacture but which is curved when installed into the curved front portion of the housing.

The vertically concave shaped curve of the control panel of the present invention is more comfortable to hold, easier to operate, and improves the operator's view of the entire set of operating keys. The optimal position for viewing and operating a switch is when the switch is perpendicular to a line of sight of the operator. For control panels with many operating elements, the operating elements at the ends of the columns of operating elements are usually difficult to view and/or operate. Thus, accessibility and viewability of the operating elements is improved and operation is less fatiguing. Because the curved shape of the circuit board is attained only when the control panel is assembled, the circuit board may be manufactured according to conventional manufacturing techniques.

Plug bases or sockets in which the switching devices are insertable are mounted to the back side of the circuit board.

The curved shape of the circuit board does not interfere with these switching devices because the devices are located on the convex curved side of the circuit board.

Assembly is simplified by mounting the operating elements to the circuit card utilizing spring clamps. The spring clamps extend through the circuit card and snap into the openings of the plug bases and are freely movable relative to the plug bases in the plug-in direction. The spring clamps are soldered on the front side of the circuit card.

To facilitate establishing contact upon plugging the switching device into the plug openings, lugs are provided between the spring clamps and contact prongs of the switching devices.

Mounting of the switching devices onto the back side of the circuit card is a great advantage during assembling and for repair.

The bottom of the plug sockets each have a groove forming a film hinge at a central portion of the plug socket which runs perpendicular to the length of the curved housing. Thus, the socket may be curved slightly to conform with the curve of the circuit card.

To prevent damage to the electrical control feed lines resulting from the weight of the suspended control panel, a cable is attached along the front of the electrical control feed line on the side facing the operator.

A further ergonomic improvement is accomplished by providing at least one handle in the form of a rib running along the length of the rear portion of the housing which provides a better grip for the control panel.

The radius of curvature of the vertically concave curve of the suspended control panel of the present invention may be modified in accordance to the number of operating elements, switching devices and/or display units. For example, the higher the number of operating elements, display and switching devices, the larger the radius of curvature of the control panel.

The suspended control panel of the present invention is designed to be hand-held. Thus, the curvature of the panel enables the angle of view of the operator to encompass the entire set of operating elements on the front cover. It is also advantageous to position the multi-functional display unit above the rows of operating elements.

Furthermore, the multi-functional display unit is preferably a display screen.

The design of the suspended control panel of the present invention provides a slanted area for labeling each operating elements and/or display device.

Despite the curved construction, wiring of the operating devices and the multi-functional display unit to the circuit card is possible.

The control feed line, which enters the housing through its front portion, is connected to the operating elements and/or the switching devices via a contact strip to the circuit card.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
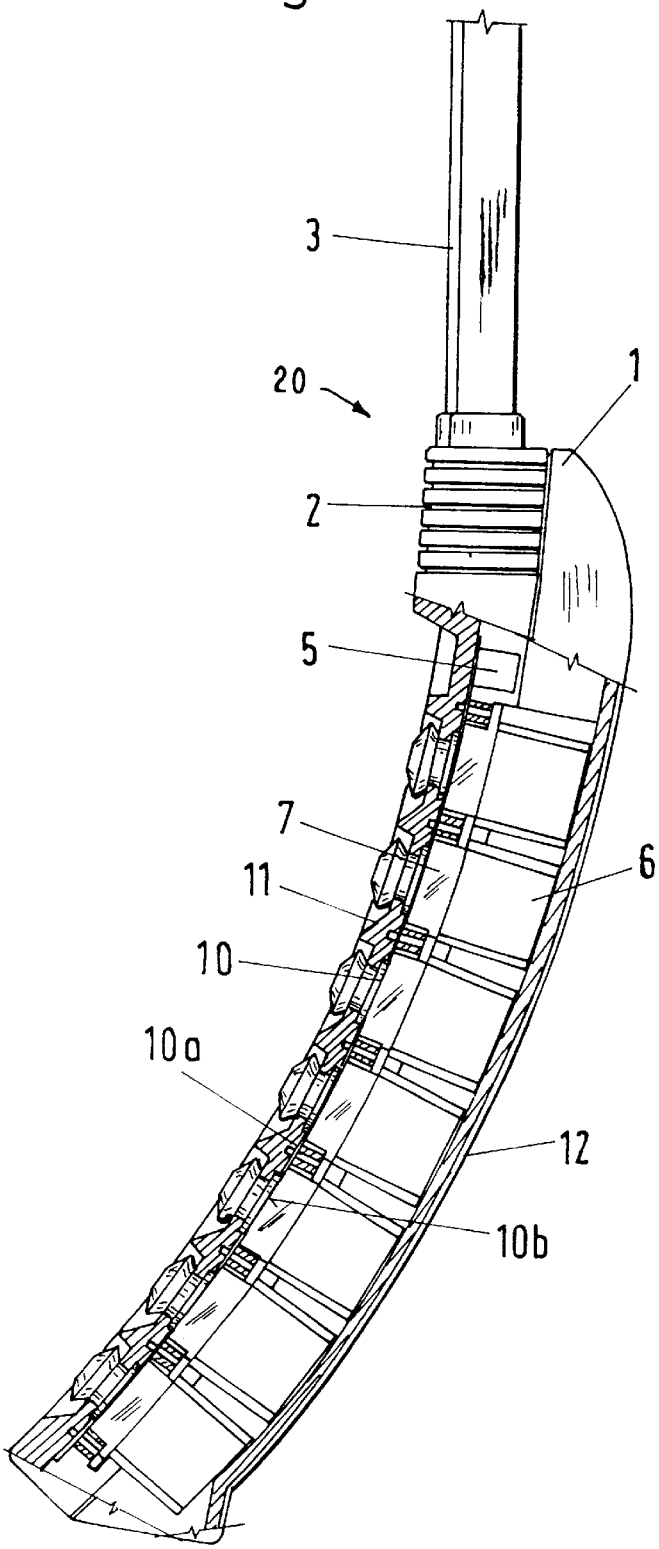
FIG. 1 is a side and partial sectional view of the suspended control panel of the present invention taken along line I—I of FIG. 2.
Figure 2:
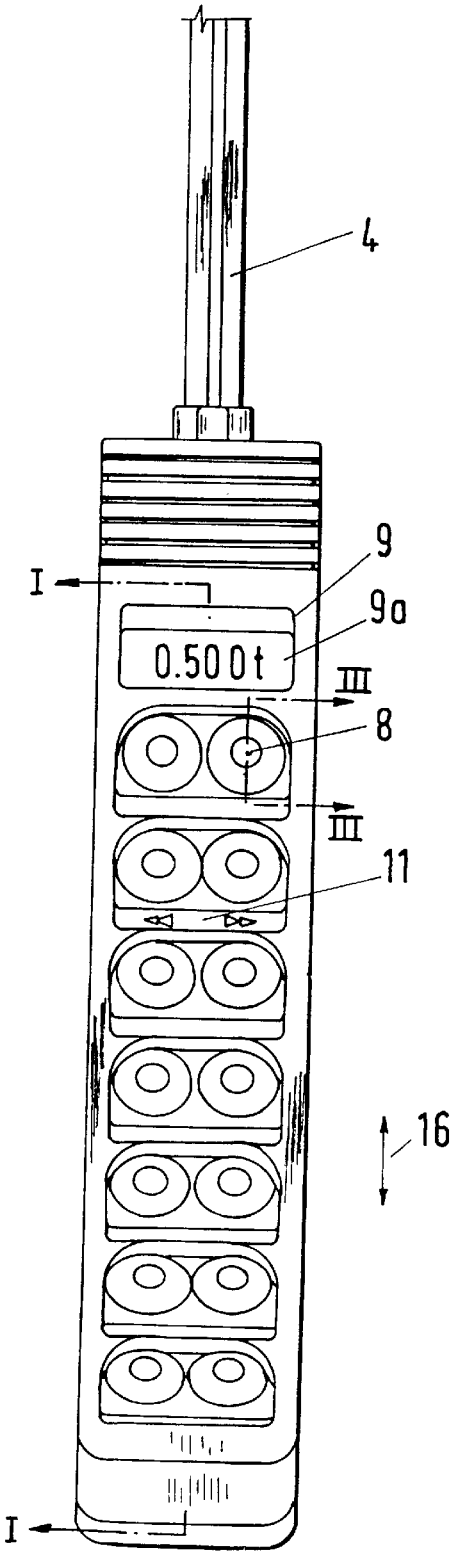
FIG. 2 is a front view of the suspended control panel of the present invention.

FIGS. 1 and 2 show a suspended control panel for remotely controlling machines, such as a crane. The control panel has a vertically extending curved housing 20 which has a rear portion 1 and a front portion 2. The curvature of the housing is vertically concave with respect to an operator who is facing the front portion 2 of the curved housing 20. A curved circuit card 10 is mounted in the front portion 2 of the housing 20 such that it follows the curved shape of the front portion 2. An electronic control line 4 enters a top end the front portion 2 of the housing 20 and is electronically connected to a contact strip 5 which is also electronically connected to the circuit card 10. The control line 4 is supported by a cable 3 which runs alongside the control line 4 and extends from the contact strip 5 to the machine being controlled (not shown). The circuit card 10 has a front side 10*a* and a back side 10*b*. The front side 10*a* accommodates a series of operating elements 8, such as keys or buttons. The series of operating elements 8 are actuatably connected to a series of switch devices 6. The switch devices 6 are electrically connected to circuit assemblies (not shown) for operating command and/or display functions. The circuit assemblies for performing the command and/or display functions may be arranged on the circuit card 10 or may be arranged remote from the housing 20 of the control panel. The switch devices 6 are mounted in plug bases or sockets 7 which are mounted on the back side 10*b* of the circuit card 10.

Figure 3:
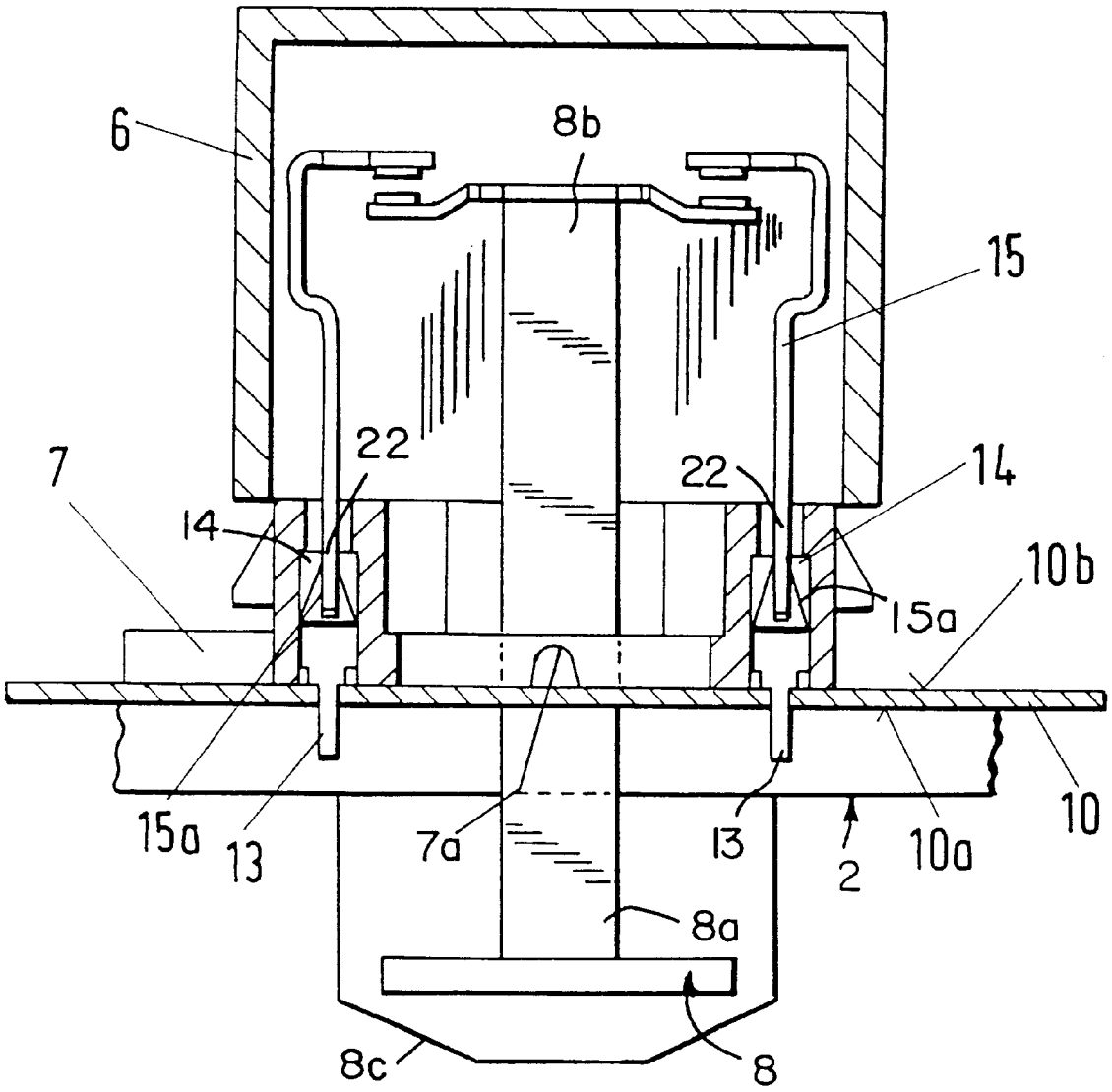
FIG. 3 is a partial sectional view of the suspended control panel of the present invention taken along line III—III of FIG. 2.

FIG. 3 shows the mounting assembly of the plug socket 7 to the circuit card 10. Spring clamps 13 extend through the circuit card 10 and snap into the recesses 14 of the plug socket 7 while still allowing play by several tenths of a millimeter in the plug-in direction. The spring clamps 13 extend through the circuit card 10 and are soldered to the front-side 10*a* of the circuit card 10.

Contact prongs 22 for the switching devices 6 are pushed into the socket openings 14 and locked into position by utilizing lugs 15*a*.

The plug sockets 7 provide an interface between components that are generally designed to be mounted on flat surfaces and the curved circuit board. Grooves that form film hinges 7*a* in the bases of the plug sockets 7 run centrally at a right angle to the longitudinal direction or length 16 of the housing 20. These film hinges 7*a* allow the plug socket to bend slightly to conform to the arch or curve of the circuit card 10 and housing 20.

The manual forces associated with operation and the stress resulting from the weight of the control panel are absorbed through a tensile relief arrangement, which is provided by means of the cable 3, shown in FIG. 1, connected to the control line 4 on the side facing the operator.

FIG. 3 shows the relationship between the operating elements 8 and the switching devices 6. The operating element 8 includes a first portion 8*a* which is outside of the switching device 6 and a second portion 8*b* which is internal to the switching device. The operating element 8 is operable to make or break a contact in the switching device 6. The example shown in FIG. 3 is a normally open contact which is closed upon operation of the operating element 8. The switching device 6 may contain a normally closed contact which is opened upon actuation of the operating element 8. Each switch may also comprise a plurality of normally open and/or normally closed contacts connectable for providing a plurality of functions. The contact prongs 22 are connected via the circuit card 10 to a control circuit of the pull switch (not shown) for providing operating functions. FIG. 3 also shows an optional cover element 8*c* which provides a seal on the front portion 2 and prevents contaminants from entering the housing 20.

In addition, FIG. 3 shows that the operating element 8 has one continuous piece comprising the first portion 8*a* and the second portion 8*b* which penetrates through the circuit card and into the switching device 6 to actuate the switching device 6. However, the switching device 6 may include an actuatable portion 8*b* which operates the internal contacts of the switching device when the operating element 8, which comprises only the first portion 8*a*, actuates the actuatable portion 8*b*. Since the actuatable portion 8*b* is part of the switching device 6, the actuatable device 8*b* may rest against the rear side of the circuit board 10 and the operating element 8*a* may rest against the front side of the circuit board 10, such that the circuit board 10 elastically deforms locally when the operating element 8*a* actuates the switching device 6. Also instead of a pushbutton, operating element 8 may comprise a rotatable or pivotable element or have any other movable actuating element which actuates the switching device 6.

The number and size of operating elements 8 is not limited to the number shown in the figures. Rather, the curve of the housing 20 is selected according to the number and size of operating elements 8 and switching devices 6. When the number of operating elements 8 and switching devices 6 increases, a curve having a larger radius of curvature is used. The preferred embodiment of housing 20 shown in FIGS. 1 and 2 comprises a radius of curvature of 515 mm. However, a radius of curvature within a preferred range of 200–800 mm may also be used to achieve the results of the invention. Even larger radius of curvatures may be used to accommodate large numbers of operating elements, such as up to 1000 mm. Although the radius of curvatures above 800 mm are not as ergonomically advantageous as the preferred range, they still provide an ergonomic advantage in readability and operability.

A multi-functional display device 9, which can have a display unit 9*a*, is located above the row of operating elements 8.

Below each operating element 8 and/or below the display unit 9*a*, a slanted surface 11 is provided for identifying the functions of the operating element 8 or display unit 9*a*.

The switching devices 6 as well as the display device 9 are electronically wired to the circuit card 10. The control line 4 runs through the front portion 2 of the housing 20 and is connected centrally to the contact strip 5 of the circuit card 10.

A further ergonomic improvement and thus, easier handling, is provided by a handle in form of a rib 12 which runs along the length of the rear portion 1 of the housing 20.

Thus, while there have been shown and described and pointed out fundamental novel features of the invention as applied to a preferred embodiment thereof, it will be understood that various omissions and substitutions and changes in the form and details of the device illustrated, and in its operation, may be made by those skilled in the art without departing from the spirit of the invention. For example, it is expressly intended that all combinations of those elements which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

The invention is not limited by the embodiments described above which are presented as examples only but can be modified in various ways within the scope of protection defined by the appended patent claims.

We claim:

1. A suspended control panel comprising:

a housing having a front side and a rear side and comprising a continuously curved front portion facing the front side of the housing and a conformingly continuously curved rear portion facing the rear side of the housing;

a bendable circuit card having a front side and a rear side, the circuit card being mounted in the front portion of the housing so as to substantially assume the shape of the front portion;

a plurality of switching devices mounted to the rear side of the circuit card;

a plurality of operating elements mounted on the front side of the circuit card and being operatively connected to the plurality of switching devices;

a plurality of plug sockets mounted on the rear side of said circuit card receiving said plurality of switching devices; and an electric feed line entering the housing and electrically connected to the circuit card;

wherein said curve of said front portion and rear portion of said housing comprises a vertically concave curve with respect to an operator facing said front portion of said housing.

2. The control panel of claim 1, further comprising a means for absorbing tension in said feed line.

3. The control panel of claim 1, further comprising a handle disposed on the rear portion of the housing extending longitudinally along the housing.

4. The control panel of claim 1, further comprising a slanted surface disposed below each one of the plurality of operating elements to identify the operating elements.

5. The control panel of claim 1, wherein a lower portion of the housing extends toward the operator facing the front portion of the housing.

6. The control panel of claim 1, wherein said curve of said front portion and said rear portion of said housing comprises a radius of curvature within a range of 200–800 mm.

7. The control panel of claim 1, wherein said curve of said front portion and said rear portion of said housing comprises a radius of curvature facilitating a handling of said device and facilitating a perpendicular line of sight to each of said plural operating elements along an entire vertical length of said control panel.

8. The control panel of claim 1, further comprising at least one display unit mounted to the front side of the circuit card above the operating elements.

9. The control panel of claim 8, wherein the at least one display unit is a multi-functional display device.

10. The control panel of claim 1, further comprising a plurality of spring clamps mounted in said circuit card, and wherein the plurality of switching devices each comprise contact prongs;

the plurality of plug sockets each have socket openings for receiving the contact prongs; and said socket openings are inserted on the spring clamps by snapping one end of the spring clamps into the socket openings such that upon insertion, the plug sockets are movable along a direction of insertion within an amount of play.

11. The control panel of claim 10, further comprising lugs disposed within each socket opening for providing contact between each contact prong and each spring clamp.

12. The control panel of claim 11, wherein the lugs lock the switching devices to the circuit card.

13. The control panel of claim 12, wherein each of the plurality of plug sockets comprises a film hinge thereby allowing the circuit card to assume the curvature of the housing.

* * * * *